US005121172A

United States Patent [19]

Stover

[11] Patent Number: 5,121,172

[45] Date of Patent: Jun. 9, 1992

[54] METHOD AND APPARATUS FOR PRODUCING SINGLE PASS HIGHLIGHT AND CUSTOM COLOR IMAGES

[75] Inventor: Raymond W. Stover, Webster, N.Y.

[73] Assignee: Xerox Corporation, Stamford, Conn.

[21] Appl. No.: 576,748

[22] Filed: Sep. 4, 1990

[51] Int. Cl.[5] ..... G03G 15/01; G03G 15/08

[52] U.S. Cl. ..... 355/327; 430/45

[58] Field of Search ..... 355/326, 327, 328, 245; 430/45, 42

[56] References Cited

U.S. PATENT DOCUMENTS

| | | | |
|---|---|---|---|
| 4,078,929 | 3/1978 | Gundlach | 96/1.2 |
| 4,459,009 | 7/1984 | Hays et al. | 355/259 |
| 4,731,634 | 3/1988 | Stark | 355/328 |
| 4,868,600 | 9/1989 | Hays et al. | 355/259 |
| 4,876,575 | 10/1989 | Hays | 355/259 |
| 4,913,348 | 4/1990 | Hays | 430/45 |
| 4,959,286 | 9/1990 | Tabb | 430/45 |
| 4,998,139 | 3/1991 | May et al. | 355/328 X |
| 5,010,367 | 4/1991 | Hays | 355/328 X |

*Primary Examiner*—Fred L. Braun

[57] ABSTRACT

Single Pass Highlight Color (SPHLC) and Single Pass Custom Color (SPCC) images are made possible on a single print using relatively high development fields compared to the prior art. Three scavengeless development housings, one with the specified custom color toner, one with a highlight color toner, and one with black toner (or another color desired for non-highlight images) are utilized. The black development system has toner of one polarity, for example, positive. The two color systems both use negatively charged toner. Alternatively, the black toner may be negatively charged in which case the custom and highlight color toners would be positively charged.

16 Claims, 3 Drawing Sheets

METHOD AND APPARATUS FOR PRODUCING SINGLE PASS HIGHLIGHT AND CUSTOM COLOR IMAGES

BACKGROUND OF THE INVENTION

This invention relates generally to the rendering of latent electrostatic images visible using multiple colors of dry toner or developer and, more particularly, to creating highlight color and/or custom color images on a single image receiver using relatively high development fields.

The invention can be utilized in such imaging technologies as xerography and ionography. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a electrically charged, colored powder which adheres to the charge pattern by electrostatic attraction. The developed image is then fixed to the imaging surface or is transferred to a receiving substrate such as plain paper to which it is fixed by suitable fusing techniques.

Recent developments in the art of xerography have been directed to highlight color imaging wherein at least two colored images are produced in a single pass. Several concepts for xerographic single pass highlight color (SPHLC) imaging systems are known. One of the more elegant and practical of these is tri-level imaging. In general in tri-level imaging, two different latent images are formed in one imaging step, with a white or background level at an intermediate voltage. With the development bias near the white level in either case, one image is charged-area developed while the other is discharged-area developed. This is accomplished by using positive toner for one color and negative toner for the other, in separate housings. Typically one toner is black and the other is a preferred color for highlighting.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900 volts. It is exposed imagewise, such that one image corresponding to charged image areas (which are subsequently developed by charged area development, i.e. CAD) stays at the full photoreceptor potential ($V_{ddp}$ or $V_{cad}$, see FIGS. 1*a* and 1*b*). The other image is exposed to discharge the photoreceptor to its residual potential, i.e. $V_c$ or $V_{dad}$ (typically 100 volts) which corresponds to discharged area images that are subsequently developed by discharged-area development (DAD). The background areas are formed by exposing areas of the photoreceptor at $V_{ddp}$ to reduce the photoreceptor potential to halfway between the $V_{cad}$ and $V_{dad}$ potentials, (typically 500 volts) and is referred to as $V_w$ or $V_{white}$. The CAD developer is typically biased about 100 volts closer to $V_{cad}$ than $V_{white}$ (about 600 volts), and the DAD developer system is biased about 100 volts closer to $V_{dad}$ than $V_{white}$ (about 400 volts).

U.S. Pat. No. 4,913,348 granted to Dan A. Hays on Apr. 3, 1990 discloses an imaging apparatus wherein an electrostatic charge pattern is formed on a charge retentive surface. The charge pattern comprises charged image areas and discharged background areas. The fully charged image areas are at a voltage level of approximately −500 volts and the background is at a voltage level of approximately −100 volts. A spatial portion of the image area is used to form a first image with a narrow development zone while other spatial portions are used to form other images which are distinct from the first image in some physical property such as color or magnetic state. The development is rapidly turned on and off by a combination of AC and DC electrical switching. Thus, high spatial resolution multi-color development in the process direction can be obtained in a single pass of the charge retentive surface through the processing stations of a copying or printing apparatus. Also, since the voltages representing all images are at the same voltage polarity unipolar toner can be employed. In order to effect development of all images with a unipolar toner, each of the development system structures is capable of selective actuation without physical movement.

There is an increasing interest in single pass custom color (SPCC). Custom color differs from highlight color in two ways. First, it generally refers to a very specific color, "customized" for a given customer or user. The customer typically will be very concerned that the hue meets his specifications. Thus, the specific color toner should be formulated in the factory rather than created by the process, as it is in process color systems, unless there is extremely good process control. Secondly, it is typically used to provide an instant identification of the document with the customer and with the customer's advertising. It would not be the color desired for normal highlighting. Ideally, it is desirable to provide SPHLC and SPCC on the same document, that is, to enable documents to be printed with both a custom color and a highlight color, along with black, in only one pass through the system. Unfortunately, tri-level is available only for two colors corresponding to the two polarities of electrical charge. Other known concepts are less elegant and introduce other problems.

U.S. Pat. No. 4,731,634 granted to Howard M. Stark on Mar. 15, 1988 discloses the method and apparatus for rendering latent electrostatic images visible using multiple colors of dry toner or developer and more particularly to printing toner images in black and at least two highlighting colors in a single pass of the imaging surface through the processing areas of the printing apparatus. Two of the toners are attracted to only one charge level on the charge retentive surface providing black and one highlight color image while two toners are attracted to another charge level to form the second highlight color image.

In order to provide two highlight color images, the device disclosed in the '634 patent must rely on very low development fields which are difficult to control. This is because the contrast voltage normally available in standard xerography is divided four rather than two ways as in conventional xerography and three ways as in tri-level, single pass, highlight color xerography.

BRIEF SUMMARY OF THE INVENTION

In accordance with the present invention, SPHLC and SPCC images are made possible on a single print using relatively high development fields compared to the prior art. The present invention utilizes three scavengeless development housings, one with the specified custom color toner, one with a highlight color toner, and one with black toner (or another color desired for non-highlight images). The black development system has toner of one polarity, for example, positive. The two color systems both use negatively charged toner. Alternatively, the black toner may be negatively charged in which case the custom and highlight color toners would be positively charged.

Normal tri-level highlight color is done using only two housings, the black one and the one with highlight color toner. The custom color housing is turned off in this mode. Custom color is done in the same way, except that the custom color housing is on and the highlight color housing is off. Now, by programming the on-off cycles of the two color housings, one can specify which image areas (to be developed by negative toner) will receive custom color and which will receive highlight color toner. The switching of the two colors can be done with high resolution such that the two colors can be butted with no objectionable boundary effects. A third color can also be obtained for selected images by developing them with both color housings.

Scavengeless development with on-off switching, or addressability in the process direction disclosed in the '348 patent is utilized. Such development is limited to the formation of only one of the two possible colors, the highlight and custom colors, on a given line transverse to the process direction. However, each of these colors is totally integrable with the black just as in standard tri-level. This limitation is not a major one for most customers, since logos and other custom-color images are typically set off from the text while highlight color is typically integrated within the text.

DETAILED DESCRIPTION OF THE PREFERRED EMBODIMENT OF THE INVENTION

Figure 1A:
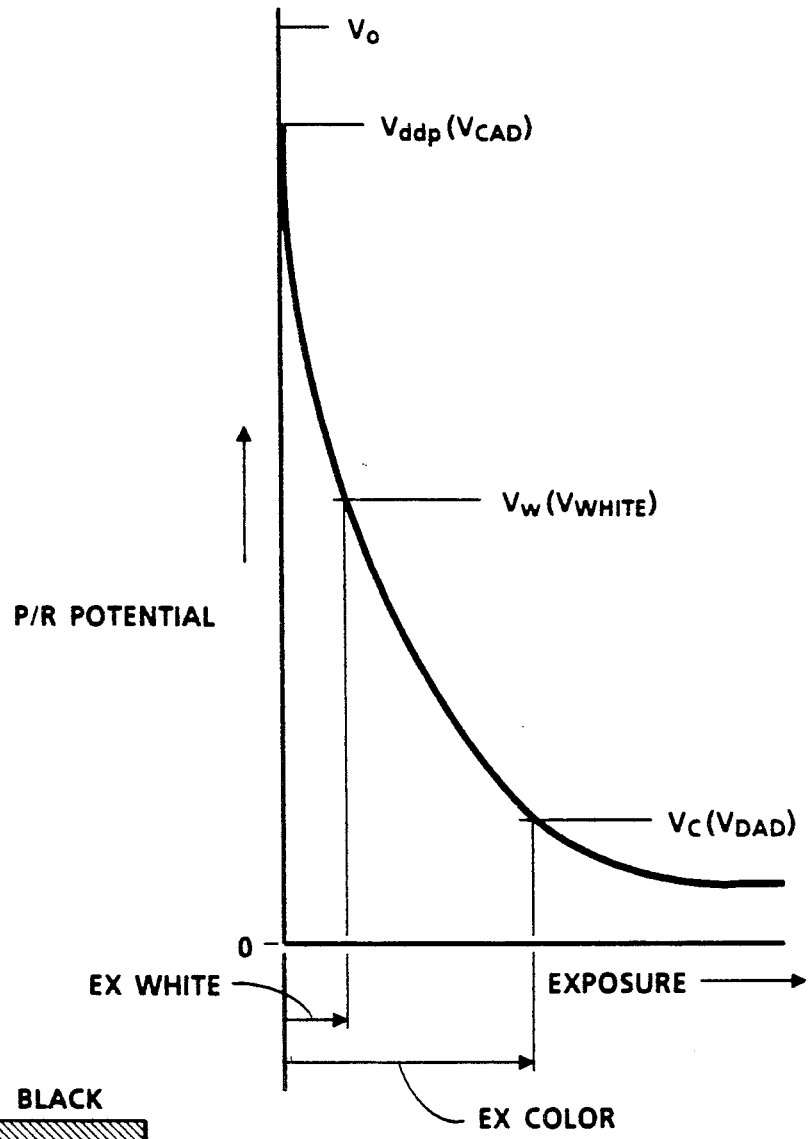
FIG. 1*a* is a plot of photoreceptor potential versus exposure illustrating a tri-level electrostatic latent image.
Figure 1B:
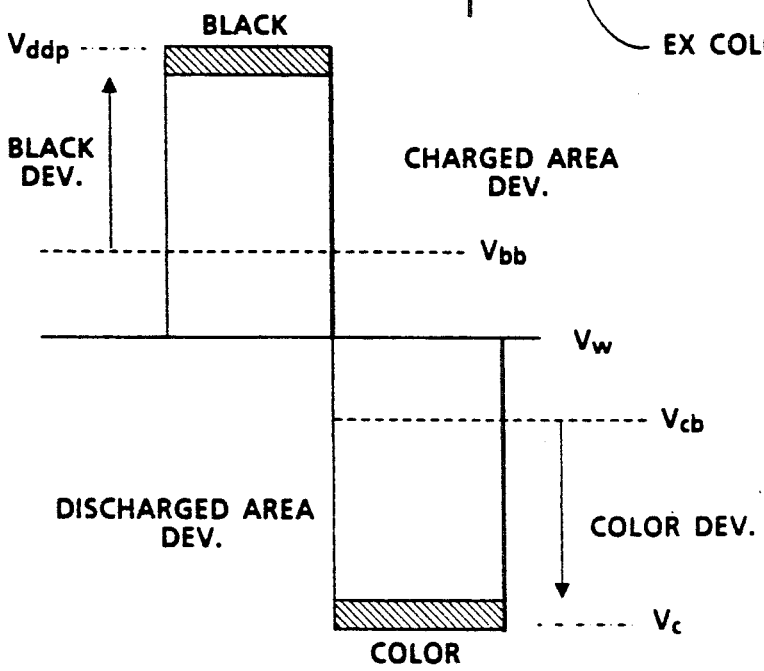
FIG. 1*b* is a plot of photoreceptor potential illustrating singlepass, highlight color latent image characteristics.
Figure 2:
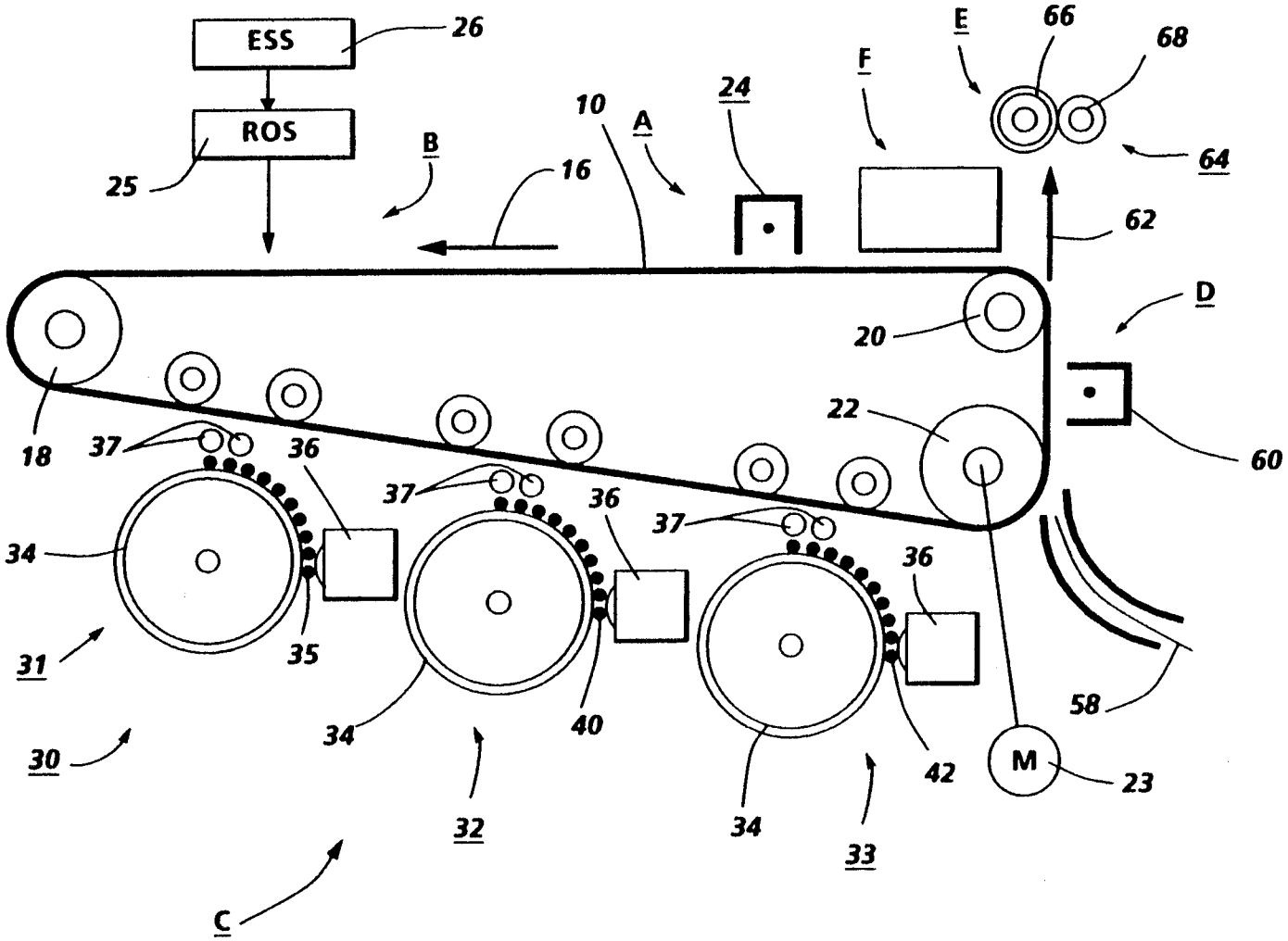
FIG. 2 is a schematic illustration of a printing apparatus incorporating the inventive features of the invention.

As shown in FIG. 2, a printing machine incorporating the invention may utilize a charge retentive member in the form of a photoconductive belt 10 consisting of a photoconductive surface and an electrically conductive substrate and mounted for movement past a charging station A, imaging station B, developer station C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the latter of which can be used as a drive roller and the former of which can be used to provide suitable tensioning of the photoreceptor belt 10. Motor 23 rotates roller 22 to advance belt 10 in the direction of the arrow 16. Roller 22 is coupled to motor 23 by suitable means such as a belt drive.

As can be seen by further reference to FIG. 2, successive portions of belt 10 pass through charging station A. At charging station A, a corona discharge device such as a scorotron, corotron or dicorotron indicated generally by the reference numeral 24 charges the belt 10 to a selectively high uniform positive or negative potential, $V_0$. Any suitable control, well known in the art, may be employed for controlling the corona charging device 24.

Next, the charged portions of the photoreceptor surface are advanced through exposure station B. At exposure station B, the uniformly charged photoreceptor or charge retentive surface 10 can be exposed to light from either an illuminated document imaged through a lens or from a digitally modulated light source such as a scanning laser or light emitting diode array. The imagewise light exposure causes the uniformly charged surface to be modified in accordance with the desired electrostatic image. For illustrative purposes, a three level (i.e. full on, full off or half power) laser Raster Output Scanner (ROS) 25 is disclosed. Information processed by an Electronic Subsystem (ESS) 26 generates digital information signals for operating the ROS as well as for controlling operation of the other components of the system.

At development station C, a development system, indicated generally by the reference numeral 30, advances developer materials into development zones. The development system 30 comprises three scavengeless development systems 31, 32 and 33. The first of these, development system, 31, need not be scavengeless, but may be any suitable development system, for example, magnetic brush development. The development systems 32 and 33 must be scavengeless. By scavengeless is meant that the developer or toner of systems 32 and 33 must not interact with an image already formed on the image receiver. Thus, the systems 32 and 33 are also known as non-interactive development systems. The development system 31 comprises a donor structure in the form of a roller 34. The donor structure 34 conveys a toner layer to the development zone (i.e.

area between the member 10 and the donor structure 34. The toner layer can be formed on the donor 34 by either a two component developer (i.e. toner and carrier) or a single component developer of toner 35 deposited on member 34 via a combination single component toner metering and charging device 36. The development zone contains an AC biased electrode structure 37 self-spaced from the donor roll 34 by the toner layer 35. The single component toner as illustrated in FIG. 2 comprises positive black toner. The donor roller 34 may be coated with TEFLON-S (trademark of E.I. DuPont De Nemours) loaded with carbon black.

For single component toner, the combination metering and charging device 36 may comprise any suitable device for depositing a monolayer of well charged toner onto the donor structure 34. For example, it may comprise an apparatus such as described in U.S. Pat. No. 4,459,009 wherein the contact between weakly charged toner particles and a triboelectrically active coating contained on a charging roller results in well charged toner. Other combination metering and charging devices may be employed. For donor roll loading with two component developer, a conventional magnetic brush can be used for depositing the toner layer onto the donor structure.

The electrode structure 37 is comprised of one or more thin (i.e. 50 to 100μ diameter) tungsten or stainless steel wires which are lightly positioned against the toner 35 on the donor structure 34. The distance between the wires and the donor is self-spaced by the thickness of the toner layer which is approximately 25μ. The extremities of the wires are supported by end blocks (not shown) at points slightly below a tangent to the donor roll surface. Mounting the wires in such manner makes the self-spacing insensitive to roll runout.

Figure 3:
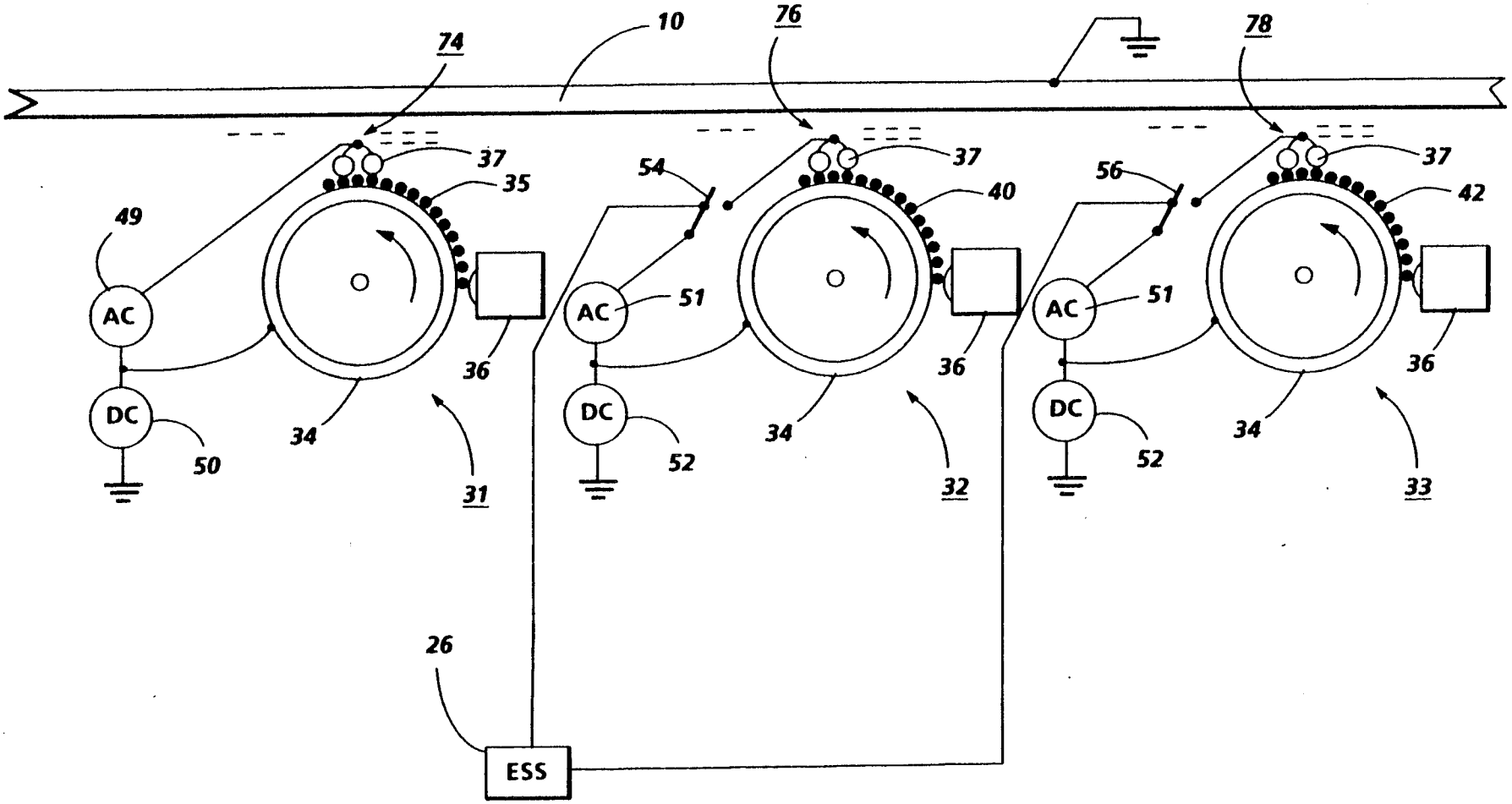
FIG. 3 is a schematic illustration of a plurality of development structures employed in the printing apparatus of FIG. 2.

The developer apparatuses of systems 32 and 33 are similar to the developer apparatus 31, like elements thereof being referenced by the same reference characters. FIGS. 2 and 3 show the donor structures 34 conveying single component toner 40 and 42 deposited thereon via a combination metering and charging devices 36 to an electrode structure 37 in second and third development zones. The single component toner 40 in this case comprises negatively charged highlight color toner, for example red toner while the toner 42 comprises a negatively charged custom color, for example blue. The donor structure can be rotated in either the 'with' or 'against' direction vis-a-vis the direction of motion of the charge retentive surface. The toners 40 and 42 may also be two component toners.

As illustrated in FIG. 3, an alternating electrical bias is applied to the electrode structure 37 via an AC voltage source 49. The applied AC establishes an alternating electrostatic field between the wires and the donor structure which is effective in detaching toner from the surface of the donor structure and forming a toner cloud about the wires, the height of the cloud being such as not to contact the charge retentive surface. The magnitude of the AC voltage is relatively low and is in the order of 200 to 400 volts peak at a frequency of about 4 kHz up to 10 kHz. A DC bias supply 50 applies a voltage to the donor structure 34 which establishes an electrostatic field between the charge retentive surface of the photoreceptor 10 and the donor structure for the purpose of providing an electric field to suppress toner deposition in the discharged area latent image on the charge retentive surface. A dc bias of approximately −650 volts is used for the development of charged area images with positively charged black toner. It is to be understood here that the image receiver is initially charged to a potential of about −900 volts with full discharge to about −100 volts.

As further illustrated in FIG. 3, a similar alternating electrical bias is applied to the electrode structure 37 associated with the developer system 32 via an AC voltage source 51. The applied AC establishes an alternating electrostatic field between the wires and the donor structure which is effective in detaching toner from the surface of the donor structure and forming a toner cloud about the wires, the height of the cloud being such as not to contact the charge retentive surface. The magnitude of the AC voltage is relatively low and is in the order of 200 to 400 volts peaks at a frequency of about 4 kHz up to 10 kHz. A DC bias supply 52 applies a voltage to the donor structure 34 which establishes an electrostatic field between the charge retentive surface of the photoreceptor 10 and the donor structure for the purpose of providing an electric field to suppress toner deposition in the charged areas on the charge retentive surface. A dc bias of approximately −350 volts is used for applying negatively charged red toner to the discharged areas representing highlight color areas.

Biases similar to those applied in the case of the developer system 32 are applied to the electrodes 37 and donor 34 of the developer system 33 for effecting deposition of custom color toner 42 on discharged areas which are different from those of the highlight color discharged areas. Such different discharged area images may represent a corporate logo.

At a spacing of approximately 25μ between the electrode structure and donor structure an applied AC voltage of 200 to 400 volts peak produces a relatively large electrostatic field without risk of air breakdown. The use of a dielectric coating on either of the structures helps to prevent shorting of the applied AC voltage. The maximum field strength produced is in the order of 8 to 16 volts/μ.

Under the control of the ESS the developer systems 32 and 33 are timely switched to render them active or inactive via switches 54 and 56. Thus, information representing highlight color and custom information may be developed as required. While these two developer systems can not develop their highlight and custom color images on the same line transverse to the process direction they can be actuated so as to develop highlight or custom color on the same line with black images. Also, the toners from these two systems can be used to form a different color image on the discharged areas of the image receiver by depositing some of each on a discharged area. The development system 31 need not be switched off since its bias precludes development of the discharged area images.

Referring again to FIG. 2, a sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. The feed roll rotates so as to advance the uppermost sheet from stack into a chute which directs the advancing sheet of support material into contact with photoconductive surface of belt 10 in a timed sequence so that the composite toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, a toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoninig rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

The ESS 26 is operatively coupled to the AC power supplies 49 and 51 and DC power supplies 50 and 52 for the purpose of rapidly switching development and off. The ESS 26 provides electrical signals to the power supplies when certain images are present in one of development zones 74, 76 and 78. The ESS comprises computer, process control members and logic circuitry based on conventional, well known technology.

In the case of the development systems 32 and 33, to rapidly switch on development with the donor roll structure rotating, the AC is applied with 200 to 400 volt peak and the DC is set at a level to effect discharged area development and control background deposition with the minimum electric field. To rapidly switch off development, the AC is turned off and the DC may be set at a level which suppresses toner deposition on the charge retentive surface. A DC level shift is desirable since mechanical disturbance of the toner layer by the self-spaced wire structures can cause some toner deposition in the image areas unless the DC electric field is in the sense to prevent the dislodge toner from depositing in the image areas. For a single AC biased 50μ wire structure, the transition distance between on and off for one color can be as narrow as 0.5 mm. For two AC biased wire structures, the transition distance is increased by the distance between the two wires, unless the wires are separately biased and separately addressable, in which case no increase in transition distance would be necessary.

What is claimed is:

1. Imaging apparatus including means for forming single polarity charge patterns having at least three different voltage levels on a charge retentive surface wherein first and second voltage levels correspond to two image areas and a third voltage level corresponds to a background area, said apparatus comprising:

means including a first developer system for applying first toner to image areas at said first voltage level;

means including a second developer system for applying a second toner to an image area at said second voltage level;

means including a third developer system for applying a third toner to an image area at said second voltage level, said first, second and third toners having different properties from each other; and means for preventing development by said third development system of an image at said second voltage level to be developed by said second development system and means for preventing development by said second development system of an image at said second voltage level to be developed by said third development system.

2. Apparatus according to claim 1 wherein said image areas at said second voltage level are different areas.

3. Apparatus according to claim 1 including means for effecting development by said third development system of an image at said second voltage level after that image has been developed by said second development system.

4. Apparatus according to claim 3 wherein said image areas at said second voltage level are the same areas.

5. Apparatus according to claim 3 wherein said means including a first developer system comprises means for electrically biasing said first developer system and wherein said means including second and third development systems comprises means for electrically biasing said second and third development systems to the same voltage level which is different from the voltage level to which said first development system is biased.

6. Apparatus according to claim 5 including switch means for selectively rendering said means including a second developer system inoperative when an image to be developed by said third developer system passes thereby; and p1 further including switch means for selectively rendering said means including a third developer system inoperative when an image to be developed by said second developer system passes thereby.

7. Apparatus according to claim 6 wherein said first development system comprises negatively charged toner and said second and third development systems comprise positively charged toner.

8. Apparatus according to claim 6 wherein said first development system comprises positively charged toner and said second and third development systems comprise negatively charged toner.

9. Apparatus according to claim 8 wherein said first, second and third toners are all different colors.

10. Apparatus according to claim 9 wherein said development systems comprise scavengeless development systems.

11. The method of creating tri-level images including the steps of:

forming a single polarity charge pattern having at least three different voltage levels on a charge retentive surface wherein first and second voltage levels correspond to two image areas and the third voltage level corresponds to a background area, said method including:

using a first developer system containing a first color toner, forming a first contrasting image in an image area at said first voltage level:

using a second developer system containing a second color toner, applying said second color toner to an image area at said second voltage level; and using a third developer system containing a third color toner, applying said third color toner to an image area at said second voltage level.

12. The method according to claim 11 including the step of selectively rendering said second developer system inoperative when an image to be developed by said third developer system passes thereby and selectively rendering said third developer system inoperative when an image to be developed by said second developer system passes thereby.

13. The method according to claim 12 wherein said step of using a first development system comprises using negatively charged toner and said steps of using second and third development systems comprises using positively charged toner.

14. The method according to claim 12 wherein said step of using a first development system comprises using positively charged toner and said steps of using second and third development systems comprises using negatively charged toner.

15. The method according to claim 14 wherein said steps of using first, second and third development systems comprises using first, second and third toners of different colors.

16. The method according to 15 wherein said steps of using development systems comprises using scavengeless development systems.

* * * * *